US005671726A

United States Patent [19]

Hsu

[11] Patent Number: 5,671,726

[45] Date of Patent: Sep. 30, 1997

[54] COOKING FUME PURIFIER

[76] Inventor: Robert Y. Hsu, 4415 Prince Pine Trail, Houston, Tex. 75509

[21] Appl. No.: 492,915

[22] Filed: Jun. 20, 1995

[51] Int. Cl.[6] ..... F24C 15/20

[52] U.S. Cl. ..... 126/299 D; 126/299 R

[58] Field of Search ..... 126/299 R, 299 D, 126/299 E

[56] References Cited

U.S. PATENT DOCUMENTS

| | | | |
|---|---|---|---|
| 2,392,038 | 1/1946 | Gaylord . | |
| 2,393,957 | 2/1946 | Baumgartner . | |
| 3,260,189 | 7/1966 | Jensen . | |
| 3,391,689 | 7/1968 | Roger . | |
| 3,827,343 | 8/1974 | Darm . | |
| 4,101,299 | 7/1978 | Bertucci | 126/299 E |
| 4,122,834 | 10/1978 | Jacobs | 126/299 D |
| 4,125,148 | 11/1978 | Molitor . | |
| 4,314,601 | 2/1982 | Giuffre . | |
| 4,364,754 | 12/1982 | Diachuk . | |
| 4,900,341 | 2/1990 | Csabai . | |
| 4,941,400 | 7/1990 | Moore | 126/299 R |
| 4,971,223 | 11/1990 | Falavigna . | |
| 4,987,882 | 1/1991 | Kaufman . | |
| 5,125,328 | 6/1992 | Grandi | 126/299 D |
| 5,456,244 | 10/1995 | Prasser | 126/299 R |
| 5,524,607 | 6/1996 | Grohman et al. | 126/299 D |

FOREIGN PATENT DOCUMENTS

| | | | |
|---|---|---|---|
| 0275127 | 7/1978 | European Pat. Off. | 126/299 E |
| 2362677 | 3/1978 | France | 126/299 R |
| 8103064 | 10/1981 | WIPO | 126/299 R |

*Primary Examiner*—Carl D. Price
*Attorney, Agent, or Firm*—Richard C. Litman

[57] ABSTRACT

A cooking fume treatment apparatus including at least one fan for drawing cooking fumes through at least one condenser. A condenser may be located above and/or below the cooking surface. A grease tray is located below each condenser for collecting condensate and particulate matter. Each condenser may be mounted to a slidable tray that is removable for maintenance. Each grease tray may be mounted to a slidable tray that is removable for maintenance. The invention also may include at least one filter for filtering the condensed fumes. Each filter may be mounted to a slidable tray that is removable for maintenance. The fumes may be exhausted into the atmosphere or recirculated back into the cooking area. Fluid from the condenser may be used for an auxiliary warming stove or other purposes.

9 Claims, 8 Drawing Sheets

COOKING FUME PURIFIER

BACKGROUND OF THE INVENTION

1. Field of the Invention

This invention relates to cooking ventilation apparatuses. More specifically, the present invention relates to a condenser used for cooking fume purification.

2. Description of the Prior Art

Kitchen ventilation decreases the amount of cooking smells that emanate into eating and living quarters. Ventilation also can aid in controlling the temperature of the cooking space. In addition to the odorous and thermal attributes of cooking fumes, a ventilation system must contend with grease accumulation. Grease accumulation, combined with the heat generated by the cooking apparatus poses potential fire hazard. A need exists for mitigating cooking odors, heat generation and grease accumulation.

Several types of cooking ventilation apparatuses are described in the literature. For example, U.S. Pat. No. 2,392,038, issued Jan. 1, 1946, to Asa K. Gaylord, describes a ventilator unit. The device includes a hood containing a fan and duct work with a plurality of downwardly extending baffles. The fan draws cooking fumes through the duct work. Grease adheres to the baffles and drips down into a tray below the baffles. A warming oven is disposed in association with the duct work to take advantage of convective heat transfer between the warm fumes and the duct work.

U.S. Pat. No. 2,393,957, issued Feb. 5, 1946, to Frank E. Baumgartner, describes a grease trap for range hoods. The device includes a hood containing a fan and duct work with a baffle superposed above a grease tray. Cooking fumes are drawn into the hood through a throughbore in the grease tray. The fumes flow in to the baffle. Grease adheres to the baffle and drips in the grease tray. The tray is removable for cleaning.

U.S. Pat. No. 3,391,689, issued Jul. 9, 1968, to Raul Roger, describes a unitized cooking range and air cleaner. The apparatus includes a hood containing a duct through which cooking fumes are drawn. The duct conveys the fumes to a filtration device mounted behind the range. A fan is located behind the filter to draw the fumes through it. The filtered air is exhausted into the atmosphere.

U.S. Pat. No. 4,125,148, issued Nov. 14, 1978, to Victor D. Molitor, describes a method for utilization of waste energy. The device includes a hood containing a water-absorbent pad through which cooking fumes are directed. When the hot cooking fumes come into contact with the water, the water evaporates and adheres to the grease particles within the fumes. The saturated air is directed into downstanding baffles which strip the air of water and grease droplets. The droplets fall into a grease tray. The cooking fumes may be heated by a heat exchanger to increase the thermal gradient and, therefor, the purification of the cooking fumes.

U.S. Pat. No. 4,314,601, issued Feb. 9, 1982, to Anthony A. Giuffre, describes a heat exchange system for recycling waste heat. The device includes a condenser and evaporator for reclaiming the heat energy of waste gases exhausted through a flue. The heat reclaimed is used to preheat fresh air used to heat a building. Condensate is not addressed in the patent.

U.S. Pat. No. 4,364,754, issued Dec. 21, 1982, to Wolodymyr Diachuk, describes an apparatus for separating foreign matter from a gas with a heat exchanger. The apparatus includes a hood constructed of heat conducting material. The hood contains a cleaning unit that swirls the gas against the sides of the hood. The sides of the hood are jacketed by a fluid which is cooler than the exhaust passing through the hood. The fluid absorbs the heat of the exhaust. Water and foreign matter condense on the sides of the hood. The matter drips into a grease tray. The heated fluid then may be used for other purposes such as dishwater.

U.S. Pat. No. 4,900,341, issued Feb. 13, 1990, to Julius S. Csabai, describes a purification system. The device includes a condenser chamber containing a plurality of glass balls and a water spray head. Chilled water drips onto the glass balls, chilling them. Cooking fumes are directed through the chilled glass balls. Cooking vapors condense on the glass balls. The condensed fumes further are drawn through a charcoal filter.

U.S. Pat. No. 4,987,882, issued Jan. 29, 1991, to Arnold S. Kaufman, describes roof-mounted kitchen hood grease exhaust blowers. The devices each include a hood containing filters and upwardly disposed duct work. The duct work conveys cooking vapors to an exhaust blower which diverts the vapors into a side-mounted discharge scoop. The discharge scoop collects grease and separates water that condenses therein. The fumes are exhausted into the atmosphere.

Clearly, the above demonstrates a need for a cooking fume purifier that provides for purifying cooking fumes with conventional, low-volume evacuation equipment and a self-contained condenser apparatus. Further, a cooking fume purifier is needed that reduces the risk of grease fires, is easily maintained and cools the cooking area. None of the above references, taken alone or in combination, are seen as teaching or suggesting the presently claimed cooking fume purifier.

SUMMARY OF THE INVENTION

The present invention overcomes the above limitations of the above inventions by utilizing closed circuit condensers mounted in slidable trays and by recirculating the cooled, purified cooking fumes. One embodiment of the invention includes a hood containing a fan and condenser. The fan draws cooking fumes through the condenser. Grease and condensate that collects on the condenser drips into a grease tray. The condenser is mounted in a slidable tray that is removable for easy maintenance. The grease tray also is removable for easy maintenance. The invention may include filters for filtering the condensed fumes. The fumes are then conveyed into the atmosphere outside the cooking area.

A second embodiment of the invention includes an auxiliary condenser. The auxiliary condenser further condenses the fumes that would pass into the atmosphere in the above embodiment. The twice-condensed fumes, having been cooled and purified, are returned into the cooking area for the cooling thereof.

A third embodiment of the invention also includes multiple condensation of the cooking fumes. The fumes are first drawn into a condenser located adjacent to the cooking surface, rather than a hood the above embodiments. Then, the condensed fumes are drawn through a number of condensers subjacent to the cooking surface. Grease and condensate that collects on the condensers drips into removable grease trays beneath the condensers. The condensed, cooled and purified cooking fumes are returned to the cooking area.

A fourth embodiment of the invention includes a hood containing condensers. One condenser is adjacent to the cooking surface. A second condenser is located above the surface. Each has a grease tray juxtaposed below. The cooking fumes are treated and recirculated back into the cooking area.

The invention may include utilizing condenser working fluid, heated during condensation, for an auxiliary warming stove or other purposes.

In consideration of the above, an object of the invention is to provide a cooking fume purifier that condenses cooking fumes and removes particulate matter therein.

Another object of the invention is to provide a cooking fume purifier that cools cooking fumes and promotes a cooler cooking environment.

A further object of the invention is to provide a cooking fume purifier that enhances safety of the cooking area.

An additional object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 1:
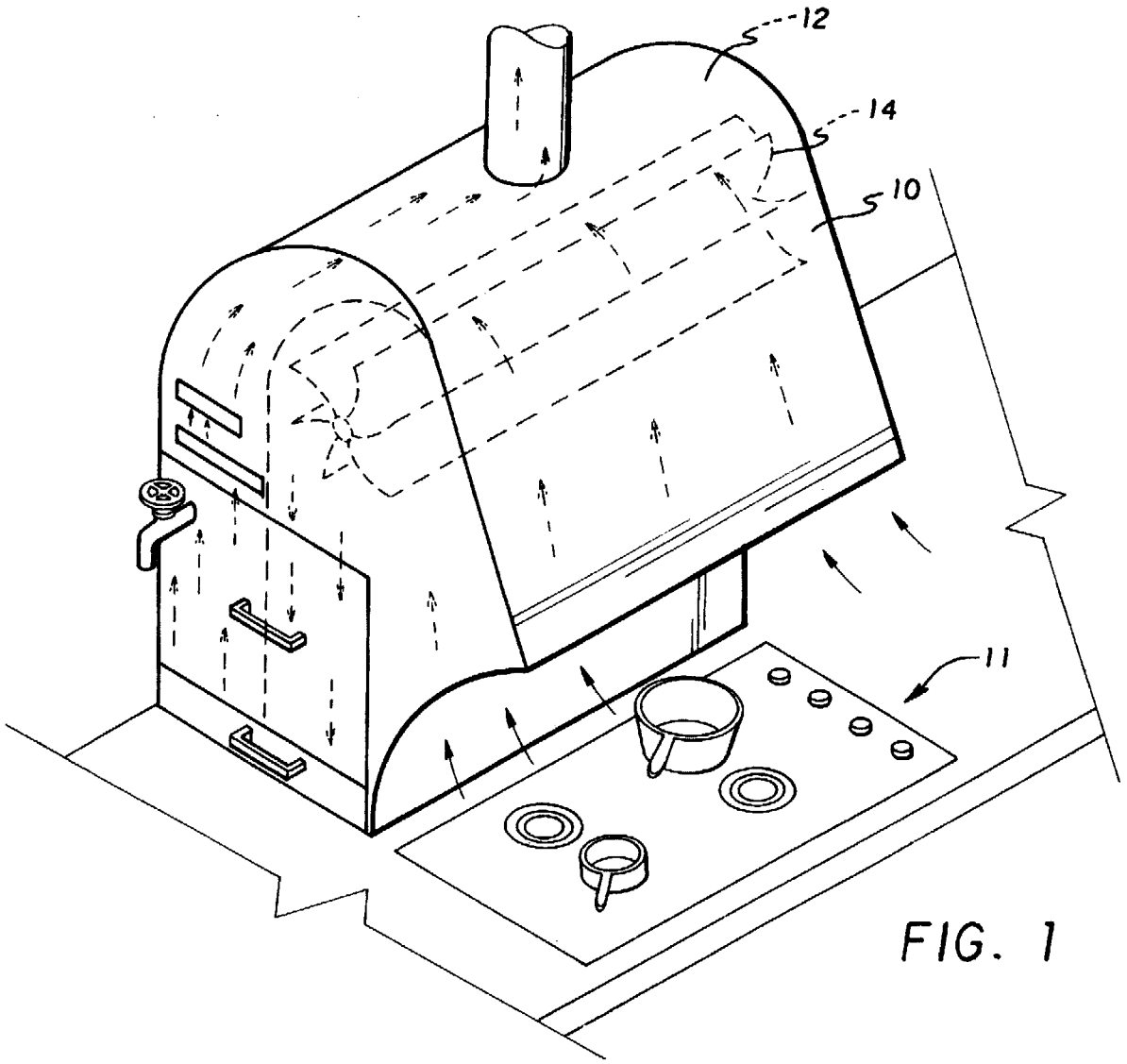
FIG. 1 is an environmental top front perspective view of a the invention.

Referring to FIG. 1, one embodiment of the invention is shown including a hood 10 superposed above a cooking surface 11. The hood 10 is shown containing one elongated fan 12 having radially extending blades 14. Any number of independently operable fans having equivalent drawing properties as the fan 12 shown may be used. The fan 12 draws cooking fumes into the hood 10 and directs the fumes downwardly.

Figure 2:
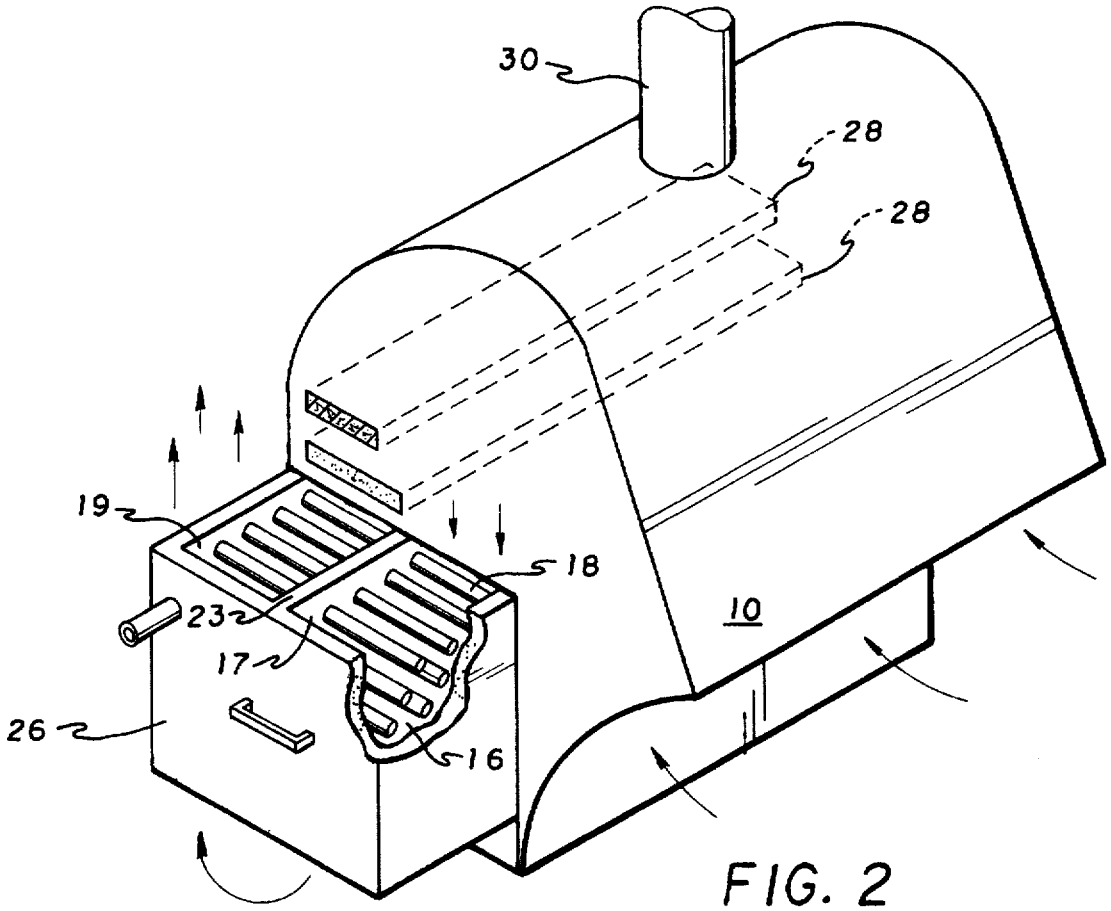
FIG. 2 is a top front perspective view of the invention with the condenser tube rack partially withdrawn.
Figure 3:
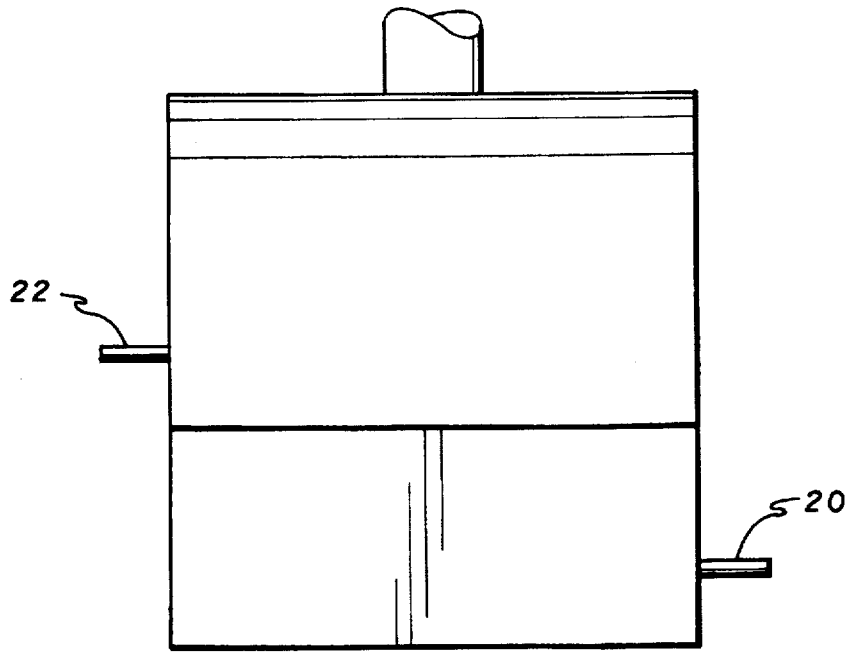
FIG. 3 is a front elevational view of the invention.

Referring also to FIGS. 2 and 3, the fumes are directed into a condenser 16. The condenser 16 is shown including a plurality of tubes 18. Any number of tubes 18 having any dimension or configuration may be used to carry out the invention. The tubes 18 conduct fluid from an inlet 20 to an outlet 22 across the area through which the fumes flow. A manifold 23 is shown approximately bisecting the condenser tubes 18. Fluid from the condenser tubes 18 flows into and cools the manifold 23. The manifold 23 has a vertical surface defining a first chamber 17 and an opposing second chamber 19. The manifold 23 has a large area on which cooking fumes may condense.

The invention may include a heat exchanging core, discussed below, rather than tubes. For brevity, the term "condenser" shall include either or any equivalent condenser means.

The fluid flowing through the condenser is, preferably, readily available tap water. However, any fluid having equivalent heat exchanging properties may be used.

The cooking fumes contain water vapor, non-condensable gases and particulate matter, such as grease or smoke carbon. When the hot fumes flow across the cool condenser tubes 18, the vapor and particulate matter condense thereon.

The condenser 16 is contained in a slidable drawer 26. The drawer 26 permits removal of the condenser 16 for easy maintenance of the condenser tubes 18 and manifold 23.

Figure 4:
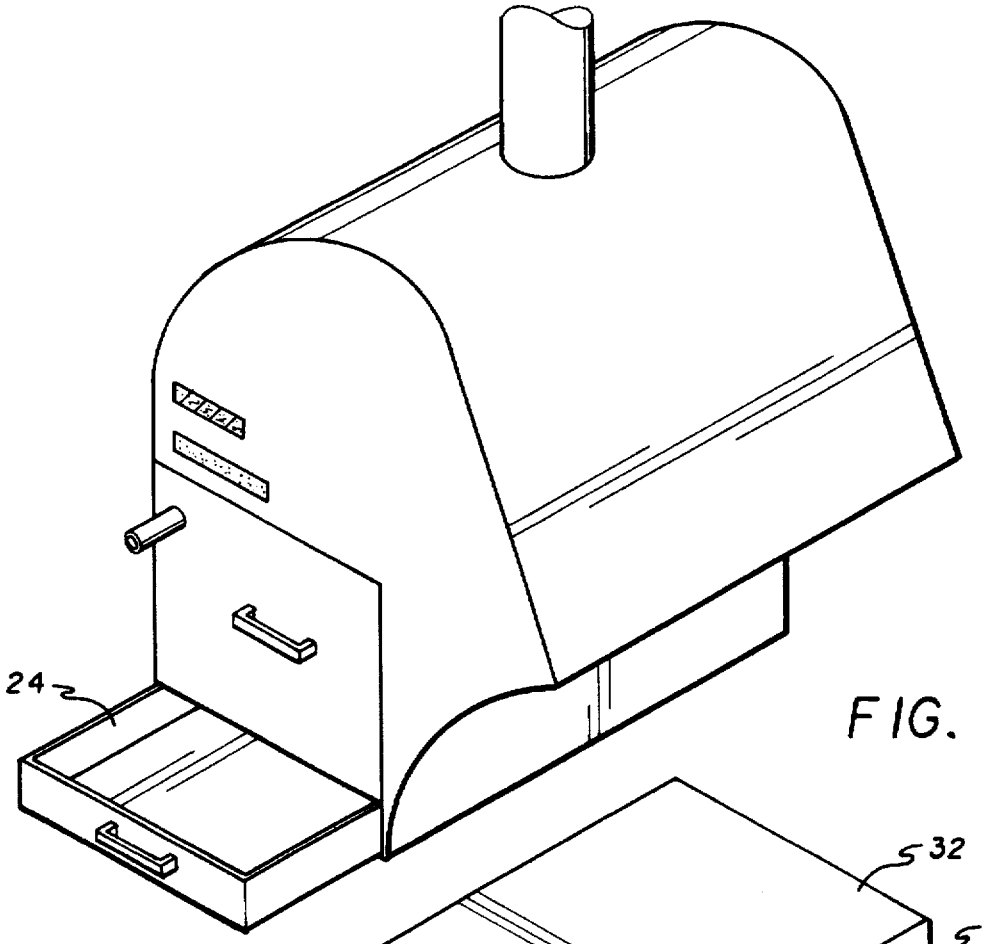
FIG. 4 is a top front perspective view of the invention with a grease tray partially withdrawn.

Referring to FIG. 4, the condensed water vapor and particulate matter that collects on the condenser tubes 18 and manifold 23 drip into a grease tray 24 located beneath the condenser 16. The grease tray 24 is removable for easy maintenance.

The invention also may include any number of filters 28. Each filter 28 may be constructed of activated charcoal, however a filter having equivalent properties may be used. Each filter 28 also is removable for easy maintenance. As seen in FIG. 2 the cooking fumes are condensed once in the first chamber 17 and again in the second chamber 19 before being filtered and conveyed into the atmosphere outside the cooking area via a flue 30.

Figure 5:
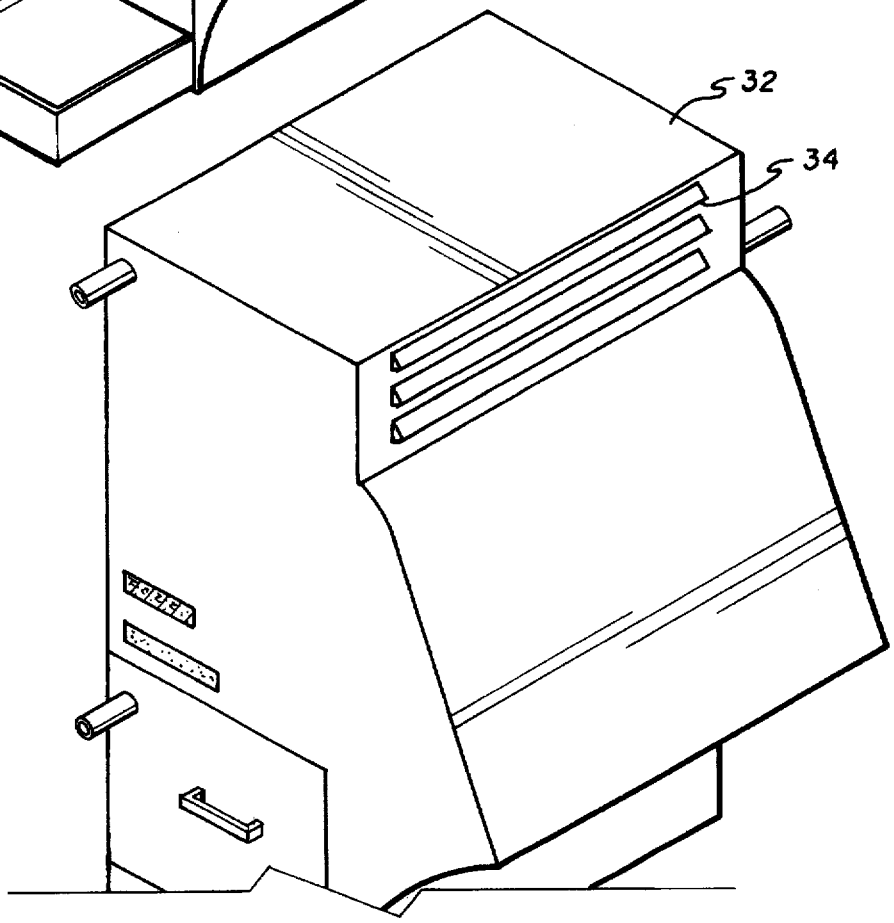
FIG. 5 is a partial top front perspective view of the invention including an auxiliary condenser.

Referring to FIG. 5, a second embodiment of the invention is shown including an auxiliary condenser 32. The auxiliary condenser 32 condenses the fumes that would pass into the atmosphere via the flue 30. However, in this embodiment, rather than expelling the fumes, the fumes are recirculated back into the cooking area through a vent 34. In addition to removing any remaining particulate matter in the cooking fumes, the fumes are cooled a second time and utilized to cool the cooking area.

Figure 6:
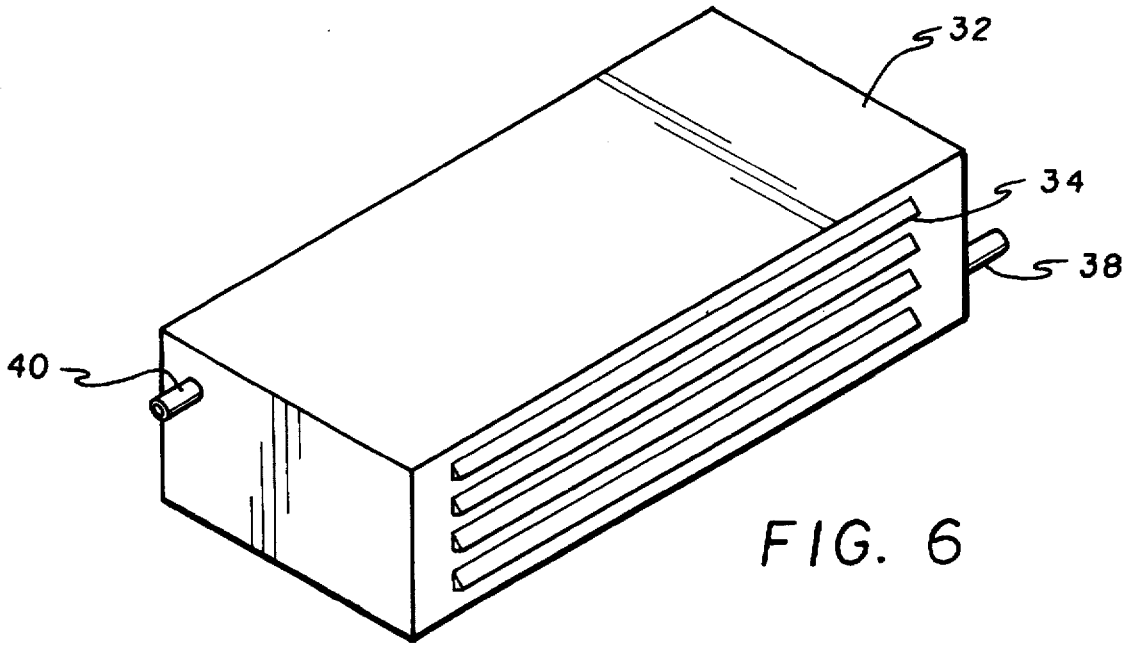
FIG. 6 is a top front perspective view of the auxiliary condenser.
Figure 7:
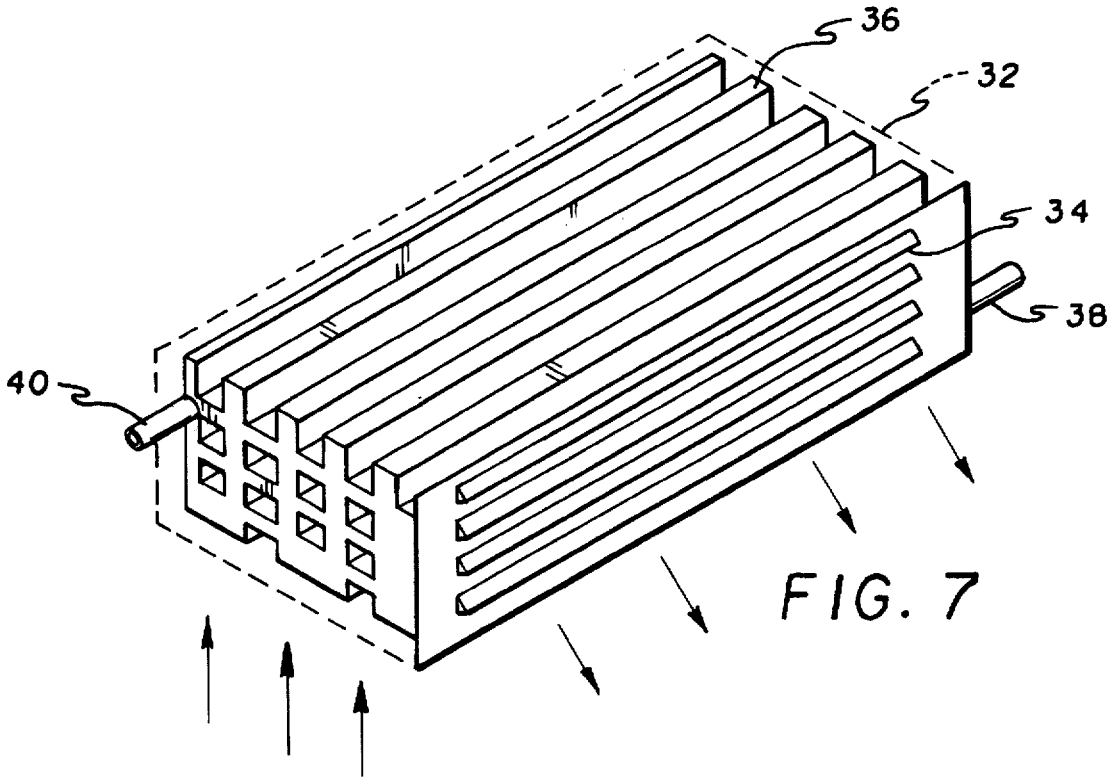
FIG. 7 is a top front perspective view of an embodiment of a condenser used to carry out the invention.

Referring also to FIGS. 6 and 7, the auxiliary condenser 32 is shown including a core 36. Condenser working fluid is introduced into the core 36 through inlet 38 and voided therefrom by outlet 40. The core 36 may be constructed from aluminum or any material suited for rapid heat exchange.

Figure 8:
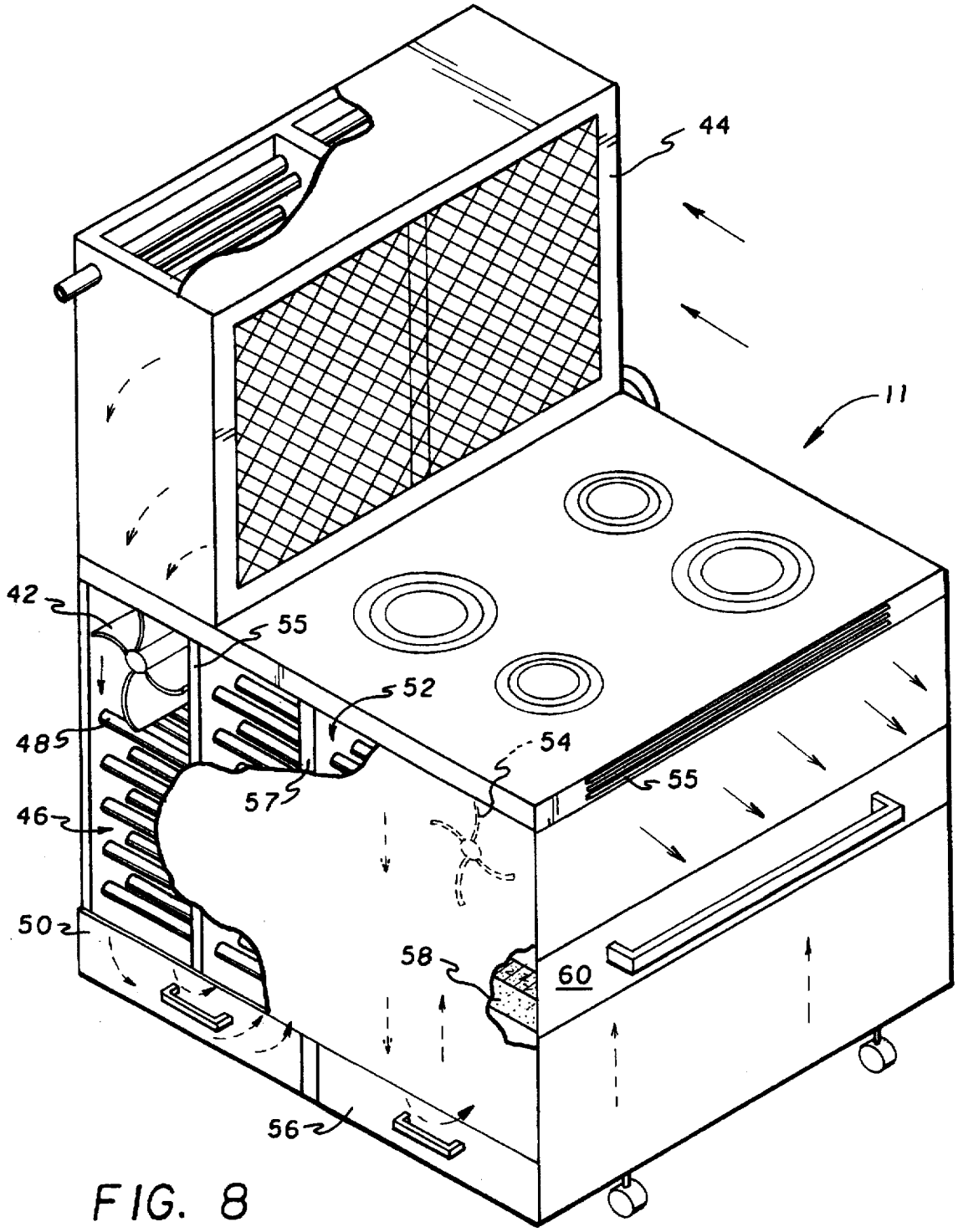
FIG. 8 is a top front perspective view of another embodiment of the invention.
Figure 9:
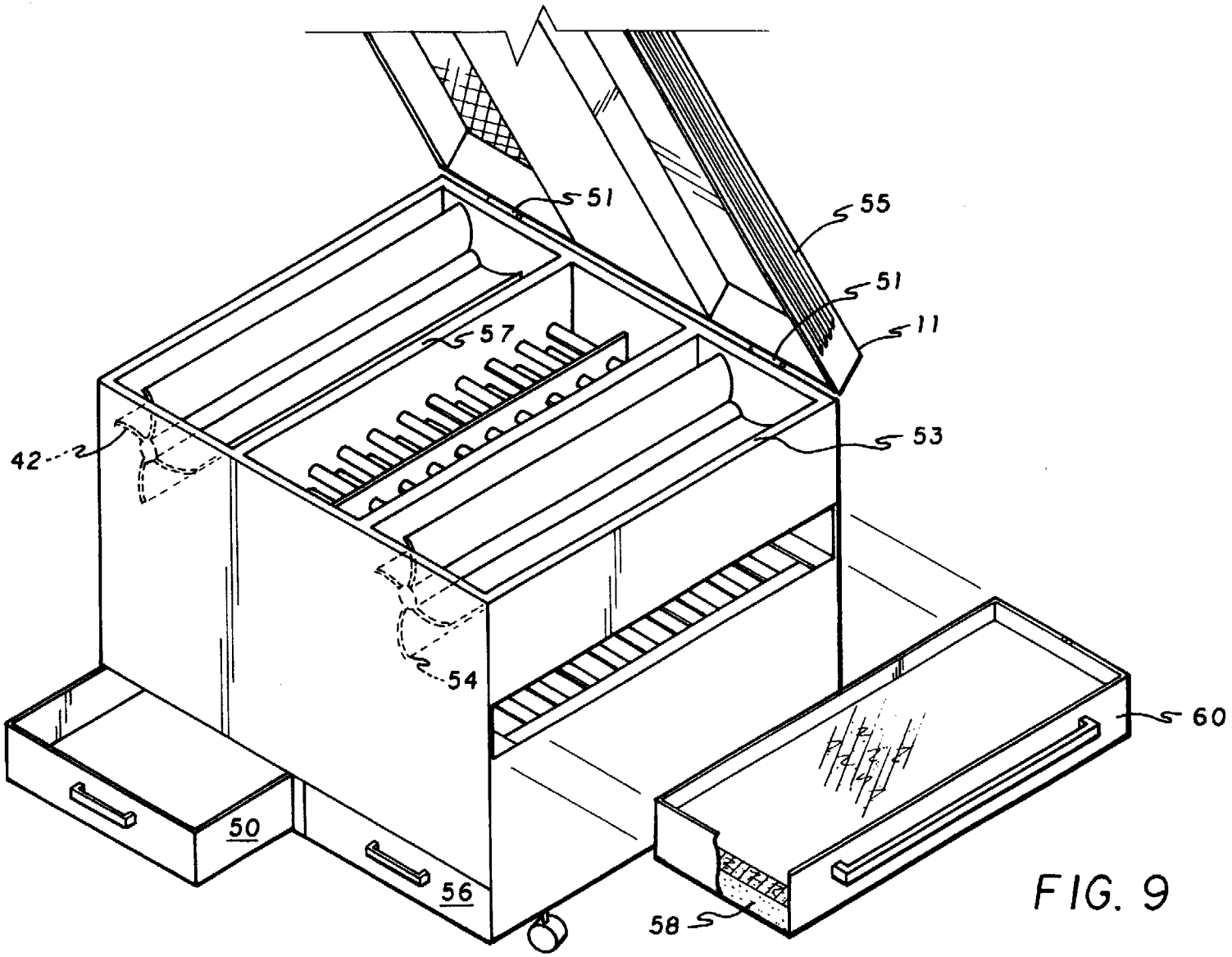
FIG. 9 is a partial top front perspective view of the embodiment shown in FIG. 8 with the doors and trays opened.

Referring to FIGS. 8 and 9, a third embodiment of the invention is shown including multiple condensers above and below the cooking surface 11. This embodiment does not include a hood. Rather, a fan 42 draws cooking fumes into a condenser 44 located adjacent to the cooking surface 11. From the adjacent condenser 44, the cooking fumes are directed into a lower condenser 46. Condensed water vapor and particulate matter that collects on the condenser tubes 48 drip into a grease tray 50 below the condenser 46. The grease tray 50 is removable for easy maintenance. This embodiment also includes hinges 51 between the cooking surface 11 and the condenser housing 53. The hinges 51 permit pivoting the cooking surface 11 open for easy maintenance of the condensers contained in the condenser housing 53.

The invention includes a second fan 54 which draws the cooking fumes through a second condenser 52. A second grease tray 56 provides for collecting condensate and particulate matter. The second fan 54 directs the cooled and purified cooking fumes back into the cooking area through a vent 55.

A manifold 55 is shown bisecting the condenser 46. Another manifold (not shown) bisects condenser 52. Yet another manifold 57 is shown interposed between condensers 46 and 52. The manifolds receive and are cooled by fluid from the condensers 46 and 52. The manifolds define large vertical areas on which cooking fumes may condense.

The invention also may include at least one filter 58 interposed between the second condenser 52 and the second fan 54. Two filters 58 are shown conveniently contained in a removable tray 60. The tray 60 permits cleaning or changing of the filters 58.

Figure 10:
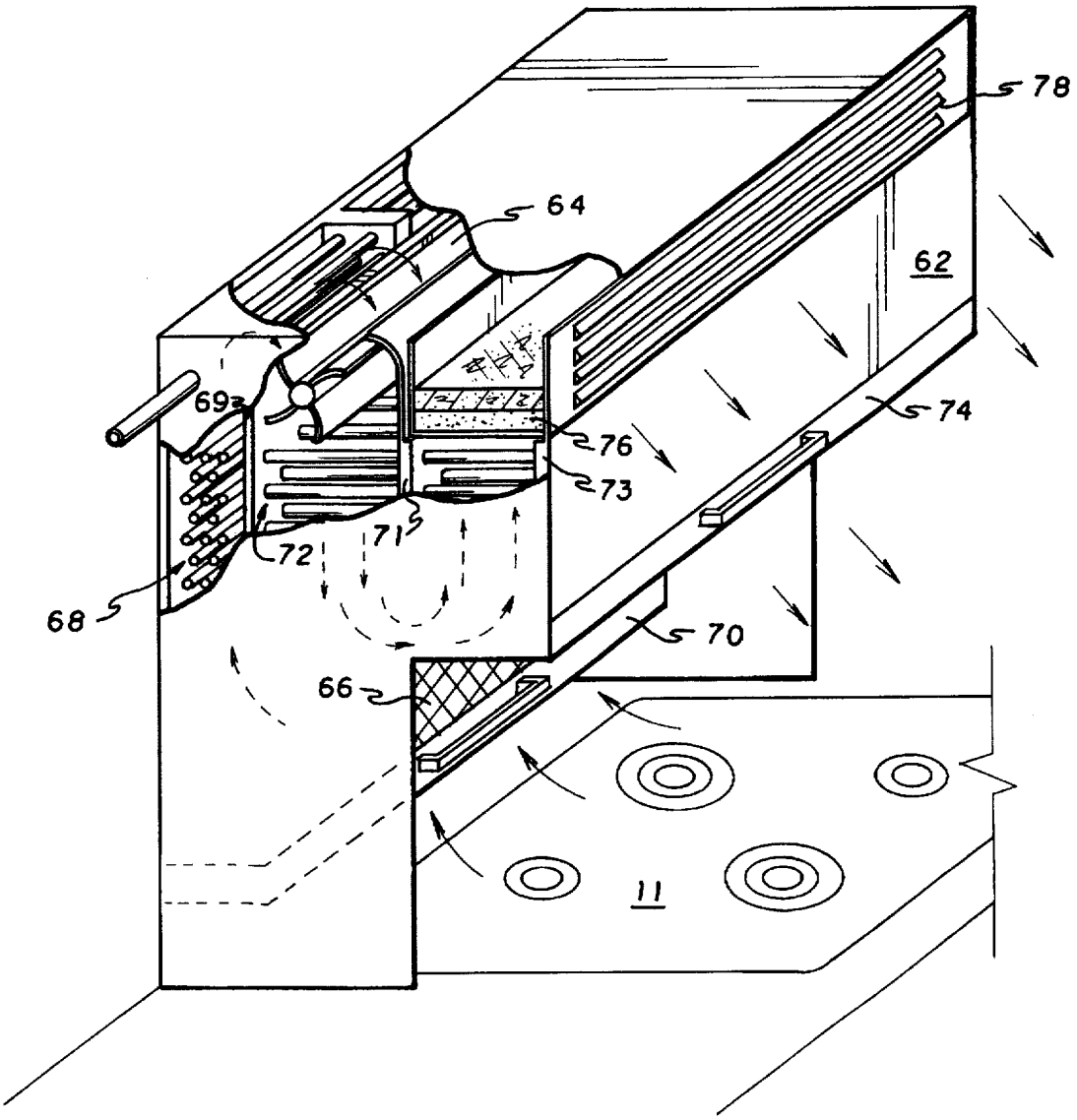
FIG. 10 is a top front perspective of another embodiment of the invention.

Referring to FIG. 10, a fourth embodiment of the invention is shown including a hood 62 above a cooking surface 11. The hood 62 contains a fan 64 which draws cooking fumes into a vertical panel 66 and through a condenser 68. The condenser 68 is bordered by a large vertical manifold 69 for enhancing the condensing capability thereof. A grease tray 70 below the condenser 68 collects condensate and particulate matter. The grease tray 70 is removable for easy maintenance. The fan 64 directs the cooking fumes into a second condenser 72. The condenser 72 includes large vertical manifolds 71 and 73 for enhancing the condensing capability thereof. A grease tray 74 below the second condenser 72 collects condensate and particulate matter. The grease tray 74 is removable for easy maintenance.

The invention also may include at least one filter 76 interposed between the condenser 72 and the vent 78. The vent 78 introduces the treated cooking fumes back into the cooking area.

Figure 11:
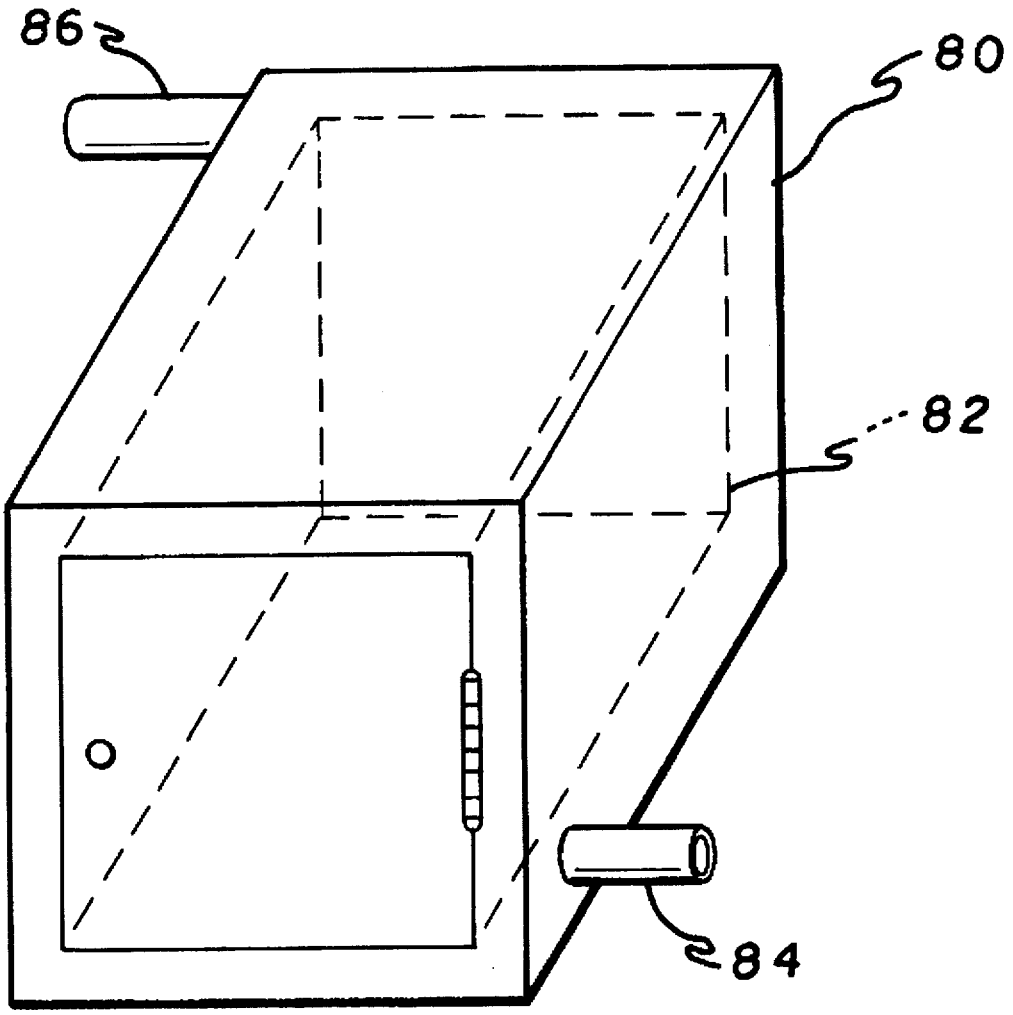
FIG. 11 is a top front perspective view of an auxiliary oven.

Referring to FIG. 11, the invention may further include an auxiliary oven 80. The auxiliary oven 80 has a warming space 82 into which comestibles may be placed for warming. Condenser working fluid, having been heated during condensation of the cooking fumes, is directed into an inlet 84. The working fluid surrounds the warming space 82 and introduces heat energy therein. The working fluid is voided through an outlet 86.

The present invention is not intended to be limited to the embodiments described above, but to encompass any and all embodiments within the scope of the following claims.

I claim:

1. An apparatus for purifying and cooling cooking fumes comprising:

a housing having a top and an opposing bottom;

a drawer slidably mounted within said housing, said drawer having a first chamber and an opposing second chamber, said first chamber being in fluid communication with said second chamber;

a heat exchanger contained in each said first and second chamber, said heat exchanger being removable with said drawer; and a fan fixed to said housing proximate said first chamber for drawing the cooking fumes into said first chamber and subsequently into said second chamber.

2. The apparatus as recited in claim 1, said heat exchanger including a plurality of condensing tubes containing a fluid.

3. The apparatus as recited in claim 2, further including a warming oven, said warming oven including conduit means for receiving said fluid from said condenser, said fluid releasing heat energy into said warming oven.

4. The apparatus as recited in claim 1, further including a slidable grease tray slidably mounted within said housing below said slidable drawer.

5. The apparatus as recited in claim 1, further including a removable filter mounted within said housing above said second chamber.

6. The apparatus as recited in claim 1, further including an auxiliary condenser mounted proximate the top within said housing above said fan, said auxiliary condenser having a heat exchanging core.

7. The apparatus as recited in claim 1, further comprising:

a second drawer slidably mounted within said housing, said second drawer being in fluid communication with said drawer, said second drawer having a third chamber and an opposing fourth chamber, said third chamber being in fluid communication with said second chamber and said fourth chamber;

a second heat exchanger contained in said second drawer, said second heat exchanger being removable with said second drawer; and a second fan fixed to said housing above said second drawer for drawing the cooking fumes from said second chamber into said third chamber and then into said fourth chamber.

8. The apparatus as recited in claim 7, further including a vent disposed proximate said second fan for returning the cooking fumes to a cooking area.

9. The apparatus as recited in claim 7, further including a removable filter mounted within said housing above said fourth chamber.

* * * * *